United States Patent [19]

Sexsmith

[11] 4,105,581

[45] Aug. 8, 1978

[54] CORROSION INHIBITOR

[75] Inventor: David R. Sexsmith, Kinnelon, N.J.

[73] Assignee: Drew Chemical Corporation, Boonton, N.J.

[21] Appl. No.: 769,918

[22] Filed: Feb. 18, 1977

[51] Int. Cl.[2] ..... C09K 3/00

[52] U.S. Cl. ..... 252/389 A; 21/2.7 A; 252/181

[58] Field of Search ..... 252/389 A, 396, 8.55 B, 252/8.55 E, 180, 181, 388, 389 R; 21/2.7 A, 2.7 R

[56] References Cited

U.S. PATENT DOCUMENTS

| | | | |
|---|---|---|---|
| 3,336,221 | 8/1967 | Ralston et al. | 252/8.55 B X |
| 3,620,667 | 11/1971 | Zinmie | 21/2.7 |
| 3,630,938 | 12/1971 | Troscinski | 252/389 A |
| 3,699,048 | 10/1972 | Krueger et al. | 252/180 |
| 3,751,372 | 8/1973 | Zecher | 252/181 |
| 3,897,209 | 7/1975 | Harris et al. | 252/396 |
| 3,963,636 | 6/1976 | Burrows et al. | 252/396 |
| 3,992,318 | 11/1976 | Gaupp et al. | 252/389 A |

*Primary Examiner*—Benjamin R. Padgett
*Assistant Examiner*—J. L. Barr
*Attorney, Agent, or Firm*—Marn & Jangarathis

[57] ABSTRACT

Corrosion inhibitor comprised of a phosphate and phosphonate, which further includes a homopolymer of maleic acid or maleic anhydride. The inhibitor is capable of effectively functioning in aqueous systems operating at an alkaline pH, and in particular a pH of above 8.5 or higher.

14 Claims, No Drawings

CORROSION INHIBITOR

This invention relates to corrosion inhibition, and more particularly, to a new and improved corrosion inhibiting composition which is particularly suitable for aqueous systems.

U.S. Pat. No. 3,992,318 discloses a three component corrosion inhibitor which includes a phosphonate, phosphate and polymer of acrylic or methacrylic acid.

Applicant has found that improved corrosion inhibition, at alkaline pH, can be obtained by replacing the polymer of acrylic or methacrylic acid with a homopolymer of maleic acid and/or maleic anhydride.

In accordance with the present invention, there is provided a corrosion inhibiting composition which includes corrosion inhibiting amounts of the following components:

(a) at least one water soluble phosphonic acid or salt thereof;

(b) at least one water soluble polyphosphate or alkali metal phosphate; and (c) a homopolymer of maleic acid or maleic anhydride or mixture thereof.

As used herein the term "water soluble" means that the compound is soluble in the amount required for corrosion inhibition. Accordingly, the compound can be sparingly soluble in water so long as the compound is sufficiently water soluble to provide, in solution, a corrosion inhibiting amount thereof.

The term "corrosion inhibiting amount" as used herein means that the component is present in an amount such that the composition inhibits corrosion and maintains such corrosion inhibition in an aqueous system.

The phosphonic acid or salt thereof component of the present invention is a compound characterized by the following group:

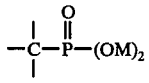

wherein each M is independently either hydrogen or a cation; e.g., a metal ion, including alkali metals, such as sodium, lithium, and potassium, alkaline earth metals, such as calcium and magnesium, aluminum, zinc, cadmium, and manganese; nickel, cobalt, cerium; lead, tin; iron, chromium and mercury; an ammonium ion; or an alkyl ammonium ion derived from amines having a low molecular weight, such as below 300, and more particularly, the alkyl amines, alkylene amines and alkanol amines containing no more than two amine groups, such as ethyl amine, diethyl amine, propyl-amine, propylene diamine, hexyl amine, 2-ethylhexylamine, N-butylethanol amine, triethanol amine and the like.

It is to be understood that as used herein the term "phosphonic acid" generically includes the phosphonic acid and the salts thereof.

As one type of phosphonic acid suitable for the purposes of the present invention, there may be mentioned the aminomethylene phosphonic acids which are characterized by the following grouping:

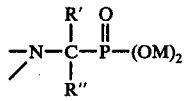

wherein M is as hereinabove defined and R′ and R″ are each individually hydrogen or hydrocarbon (preferably $C_1 - C_5$ alkyl).

The aminomethylene phosphonic acids are preferably characterized by the following structural formula:

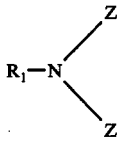

wherein Z is

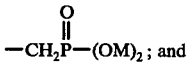

$R_1$ is (a) Z

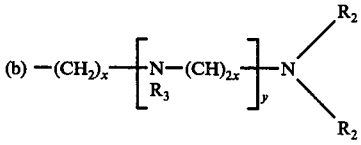

wherein each $R_2$ is independently either Z, hydrogen, $-CH_2-C-OM$ or $CH_2CH_2OH$ and $R_3$ is either hydrogen, Z or $C_1 - C_{20}$ alkyl.

$x$ is 1 to 20

$y$ is 0 to 18 and total of $x + y$ is no more than 20.

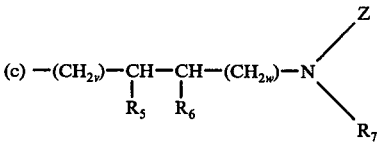

wherein $R_5$ is hydrogen or hydroxyl;

$R_6$ is hydrogen or alkyl, preferably an alkyl group containing 1 to 6 carbon atoms and $R_5$ and $R_6$ together with the two carbon atoms to which they are attached can form a cycloalkyl ring, preferably having from 4 to 6 carbon atoms.

$v$ is — to 20;

$w$ is 0 to 20, — and the total of $v + w$ is no more than 20;

$R_7$ is hydrogen or Z;

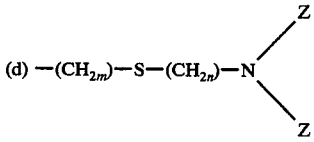

wherein $m$ and $n$ are each 1 to 3.

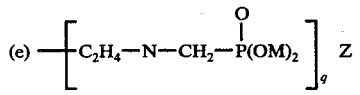

wherein $q$ is 1 to 20.

(f) $—R_8(OR_9)_r(OR_{10})$ wherein $R_8$ is $C_3 - C_5$ alkylene $R_9$ is $C_2 - C_5$ alkylene $R_{10}$ is $C_1 - C_5$ alkyl $r$ is 1 to 20.

As a further type of aminomethylene phosphonic acid, there may be mentioned the silicon containing amino methylene phosphonic acids, as described in U.S. Pat. No. 3,716,569 which is hereby incorporated by reference.

As still another type of aminomethylene phosphonic acid, there may be mentioned the nitrogen-heterocyclic phosphonic acids characterized by aminomethylene phosphonic acids bonded directly or indirectly to the nitrogen atom of the heterocyclic ring, as disclosed in U.S. Pat. No. 3,674,804 which is hereby incorporated by reference.

As still another type of phosphonic acid which is suitable for the purposes of the present invention, there may be mentioned the ethane diphosphonic acids. The ethane diphosphonic acids are characterized by the following structural formula:

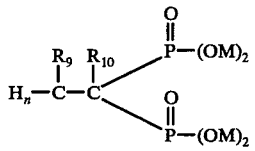

wherein

M is as defined previously; $n$ is 1 or 2 to provide the required number of hydrogen atoms;

$R_9$ is either hydrogen, alkyl (preferably containing 1 to 4 carbon atoms), oxygen, halogen, hydroxy, cyano, $—N(R_{11})_2$ wherein $R_{11}$ is hydrogen or alkyl containing 1 - 30 carbon atoms; $XR_{12}$ wherein X is sulfur or oxygen and $R_{12}$ is alkyl containing 1 - 30 carbon atoms, preferably 1 - 4 carbon atoms; phenyl; benzyl; acetoxy; $SO_3R_{11}$ wherein $R_{11}$ is as above; benzoyl; $CO_2H$ and $CH(COOR_{11})_2$ wherein $R_{11}$ is as defined above;

$R_{10}$ is as above except for oxygen and alkyl, and $R_{10}$ is hydrogen when $R_9$ is oxygen;

and one of $R_9$ and $R_{10}$ is hydroxy, except that when $R_9$ is oxygen $R_{10}$ is hydrogen.

The ethane diphosphonic acids are disclosed in U.S. Pat. No. 3,644,151 which is hereby incorporated by reference.

As representative examples of phosphonic acids which are preferably employed in the corrosion inhibiting composition of the present invention, there may be mentioned:

ethane-1-hydroxy-1, 1-diphosphonic acid, amino tri (methylene phosphonic acid), ethylene diamine tetra (methylene phosphonic acid), hexamethylene diamine tetra (methylene phosphonic acid); and the water soluble salts thereof.

The phosphate component of the composition of the present invention may be any one of the wide variety of water soluble inorganic polyphosphates which are known in the art or an alkali metal phosphate. In general, the polyphosphates include an alkali metal oxide and/or alkaline earth metal oxide and/or a zinc oxide in a ratio to $P_2O_5$ ratio of from about 0.4:1 to about 2:1, with sodium and potassium oxide being preferred. The polyphosphate may also be in acid form, with the water to $P_2O_5$ ratio being from about 0.4:1 to 2:1. Suitable water soluble inorganic polyphosphates include, for example, all water soluble glassy and crystalline phosphates; i.e., the so-called molecularly hydrated phosphates of alkali metals, alkaline earth metals and zinc, as well as zinc-alkali metal phosphates and mixtures thereof. The acids corresponding to these salts, such as pyrophosphoric ($H_4P_2O_7$) and higher phosphoric acids are also suitable. Examples of especially suitable polyphosphates are:

| | |
|---|---|
| Sodium Tripolyphosphate | $[Na_5 - P_3O_{10}]$ |
| Sodium Acid Pyrophosphate | $[Na_2H_2P_2O_7]$ |
| Glassy Phosphates | $[(NaPO_3)_x$ x = 6, 13, 21] |
| Tetrasodium Pyrophosphate | $[Na_4P_2O_7]$ |
| Potassium Tripolyphosphate | $[K_5P_3O_{10}]$ |
| Tetrapotassium Pyrophosphate | $[K_4P_2O_7]$ and the like |

The third component of the composition is a polymer of maleic acid or maleic anhydride. The polymer generally has a number average molecular weight of at least 300, with the number average molecular weight generally not exceeding 5000; however, higher molecular weights can be employed, most generally, the number average molecular weight is from 500 to 2000.

The three components of the composition of the present invention are incorporated therein in corrosion inhibiting amounts; i.e., the three components are present in the composition in an amount which is effective to prevent corrosion upon addition of the composition to a system subject to corrosion. In general, the weight ratio of phosphonate to phosphate (calculated as $PO_4$) in the composition ranges from about 0.1:1 to about 10:1, and preferably from about 0.5:1 to about 3:1. In general, the homopolymer of maleic acid or maleic anhydride is present in the composition in a polymer to phosphate (calculated as $PO_4$) ratio of from about 0.01:1 to about 10:1 and preferably in an amount from about 0.1:1 to about 1:1, all by weight. It is to be understood that although the hereinabove described amounts of components employed in the composition of the present invention are preferred, the overall scope of the invention is not limited to such amounts. The choice of optimum amounts of the various components is deemed to be within the scope of those skilled in the art from the teachings herein.

The composition of the present invention, including the hereinabove described three components, is generally employed in combination with a liquid vehicle, preferably water. It is to be understood, however, that the composition can also be employed in solid form, or the components can be individually added to the aqueous system. In general, the composition is employed using water as a vehicle, with the components being added to water to provide a concentration of the three components in the water from about 1 to about 80%, and preferably from about 10 to about 40%, all by weight. The composition may also include other water treatment components, such as, defoamers, dispersants, biocides, etc. and accordingly, the addition of such components is within the spirit and scope of the present invention.

The composition of the present invention containing corrosion inhibiting amounts of the hereinabove described three components is added to a system subject to corrosion in a corrosion inhibiting amount; i.e., in an amount which is effective to prevent corrosion in the system. This amount will vary depending upon the system to which the composition is added and is influenced by factors, such as area subject to corrosion, processing conditions (pH, temperature), water quantity, etc. In general, the composition of the present invention is added to the system to provide at least 1 ppm of the phosphate component, and preferably from about 5 to about 25 ppm of the phosphate component. In general, the phosphate component is not added in an amount in excess of about 50 ppm. (The phosphate content is in parts by weight, calculated as $PO_4$).

The corrosion inhibitor of the present invention is generally and preferably employed in aqueous systems in which corrosion is a problem, and in particular, in aqueous cooling systems. The overall scope of the invention, however, is not limited to such uses, and other uses should be apparent from the teachings herein.

The corrosion inhibiting composition of the present invention has been found to be particularly effective in that such a composition is capable of providing improved corrosion inhibition in alkaline systems, and in particular in systems where the pH is 8.5 or greater as compared to compositions in which acrylic or methacrylic acid polymers are employed in combination with a phosphate and phosphonate.

The invention will be further described with respect to the following examples; however, the scope of the invention is not to be limited thereby.

EXAMPLES

The following components are employed for testing corrosion efficiency at an alkaline pH:

| Composition (Parts by weight) | A | B |
|---|---|---|
| sodium hexametaphosphate | 15 | 15 |
| amino (trimethylene phosphonic acid) | 4 | 0 |
| ethane-1-hydroxy-1, 1-diphosphonic acid | 0 | 4 |
| hydrolysed polymaleic anhydride | 1 | 1 |

Compositions A & B are tested for corrosion inhibiting efficiency in standard "synthetic cooling water" at a pH of 8.5 – 9.0 and at an active solids basis of 20 ppm. The corrosion rates for compositions A & B are 8.7 and 10.7 mils per year.

Composition A is further tested in standard "synthetic cooling water" containing 2 ppm of hydrogen sulfide at a pH of 8.5–9.0 and active solids basis of 20 ppm. The determined corrosion rate is 6.9 mils per year.

Numerous modifications and variations of the present invention are possible in light of the above teachings and, therefore, within the scope of the appended claims the invention may be practiced otherwise than as particularly described.

What is claimed is:

1. In a corrosion inhibitor including a corrosion inhibiting amount of (a) a water soluble polyphosphate or alkali metal phosphate and (b) a water soluble phosphonate or salt thereof, the improvement comprising:

said composition further including a corrosion inhibiting amount of (c) a polymer selected from the group consisting of the homopolymers of maleic acid and maleic anhydride and mixtures thereof.

2. The corrosion inhibitor of claim 1 wherein the weight ratio of phosphonate to phosphate, calculated as $PO_4$, is from 0.1:1 to 10:1.

3. The corrosion inhibitor of claim 2 wherein the weight ratio of said polymer to phosphate, calculated as $PO_4$, is from 0.01:1 to 10:1.

4. The corrosion inhibitor of claim 3 wherein the phosphonate is at least one member selected from the group consisting of ethane-1-hydroxy-1, 1-diphosphonic acid, amino tri (methylene phosphonic acid), ethylene diamine tetra (methylene phosphonic acid), hexamethylene diamine tetra (methylene phosphonic acid), and water soluble salts thereof.

5. The corrosion inhibitor of claim 4 wherein the phosphate is at least one member selected from the group consisting of sodium hexameta phosphate and tetrapotassium pyrophosphate.

6. The composition of claim 5 wherein the phosphonate is amino (trimethylene phosphonic acid).

7. The composition of claim 6 wherein the phosphate is sodium hexametaphosphate.

8. In a process for inhibiting corrosion in an aqueous system by the addition of corrosion inhibiting amounts of (a) a water soluble polyphosphate or alkali metal phosphate and (b) a water soluble phosphonate or salt thereof, the improvement comprising:

further adding to the aqueous system a corrosion inhibiting amount of a polymer selected from the group consisting of the homopolymers of maleic acid and maleic anhydride and mixtures thereof.

9. The process of claim 8 wherein component (a) is added in an amount of from 1 to 50 ppm and the weight ratio of component (b) to component (a) is from 0.1:1 to 10:1 and the weight ratio of component (c) to component (a) is from 0.01:1 to 10:1.

10. The process of claim 9 wherein the phosphonate is at least one member selected from the group consisting of ethane-1-hydroxy-1, 1-diphosphonic acid, amino tri(methylene phosphonic acid), ethylene diamine tetra (methylene phosphonic acid), hexamethylene diamine tetra (methylene phosphonic acid), and water soluble salts thereof.

11. The process of claim 10 wherein the phosphate is at least one member selected from the group consisting of sodium hexameta phosphate and tetrapotassium pyrophosphate.

12. The process of claim 11 wherein the phosphonate is amino (trimethylene phosphonic acid).

13. The process of claim 12 wherein the phosphate is sodium hexametaphosphate.

14. The process of claim 10 wherein the aqueous system is at a pH of at least 8.5.

* * * * *